US005702234A

United States Patent [19]

Pieters

[11] Patent Number: 5,702,234

[45] Date of Patent: Dec. 30, 1997

[54] FLUID PUMP WITH BEARING SET HAVING LUBRICATION PATH

[75] Inventor: Ferdinandus A. Pieters, Camas, Wash.

[73] Assignee: Micropump, Inc., Vancouver, Wash.

[21] Appl. No.: 566,300

[22] Filed: Dec. 1, 1995

[51] Int. Cl.[6] ..... F04B 17/00; F04C 2/18; F04C 15/00

[52] U.S. Cl. ..... 417/53; 417/420; 418/1; 418/102; 418/206.7; 418/206.8

[58] Field of Search ..... 417/53, 420; 418/1, 418/102, 132, 201.1, 206.7, 206.8

[56] References Cited

U.S. PATENT DOCUMENTS

| | | | |
|---|---|---|---|
| 2,382,042 | 8/1945 | Etnyre | 418/200 |
| 2,745,356 | 5/1956 | Lauck | 418/132 |
| 2,750,891 | 6/1956 | Berry | 418/200 |
| 2,931,303 | 4/1960 | Dlugos | 418/200 |
| 2,965,040 | 12/1960 | Eisenberg | 418/102 |
| 2,993,450 | 7/1961 | Weigert | 418/102 |
| 3,272,140 | 9/1966 | Curry et al. | 418/200 |
| 3,690,793 | 9/1972 | Pollman et al. | 418/102 |
| 3,716,306 | 2/1973 | Martin, Sr. et al. | 417/420 |
| 4,065,235 | 12/1977 | Furlong et al. | 417/420 |
| 4,111,614 | 9/1978 | Martin et al. | 417/420 |
| 4,127,365 | 11/1978 | Martin et al. | 417/420 |
| 4,395,207 | 7/1983 | Manttari et al. | 418/102 |
| 4,846,641 | 7/1989 | Pieters et al. | 417/420 |
| 5,027,653 | 7/1991 | Foran, Jr. | 418/102 |
| 5,076,770 | 12/1991 | Dabling et al. | 418/102 |
| 5,105,911 | 4/1992 | Atkinson | 184/6.12 |
| 5,466,131 | 11/1995 | Altham et al. | 417/420 |

FOREIGN PATENT DOCUMENTS 2729208 5/1979 Germany .

OTHER PUBLICATIONS

Tuthill Pump Company, Concord, CA, Gearpump, Model No. 9712T (Photographs) 5 sheets.

*Primary Examiner*—John J. Vrablik

*Attorney, Agent, or Firm*—Klarquist Sparkman Campbell Leigh & Whinston, LLP

[57] ABSTRACT

A gear pump is disclosed having an integrated gear cavity and bearing receptacle that includes a fluid path for lubricating the bearings. The preferred embodiment includes a helical gear pump having a manifold with inlet and outlet ports. The integrated gear cavity and bearing receptacle are located in a one piece molded end cap. The bearing receptacle receives a coupled bearing assembly. Together, the coupled bearing assembly and the bearing receptacle define a supply path outside the bearings along the bearing receptacle and a return path through the bearings so that fluid can pass by, and lubricate, the bearing-axle interface.

8 Claims, 2 Drawing Sheets

FLUID PUMP WITH BEARING SET HAVING LUBRICATION PATH

BACKGROUND OF THE INVENTION

1. Field of the Invention

This invention pertains to lubrication of working components within fluid gear pumps.

2. Description of the Related Art

Gear pumps, as the name implies, are fluid pumps that use gears to pump fluid. Gear pumps typically consist of a housing having an inlet, a fluid conduit and an outlet. In the housing is a gear cavity, within which gears meshingly engage and rotate. Fluid enters the gear cavity near the engagement of the gears and on a side wherein the gear teeth are disengaging. As fluid enters the gear cavity it is entrained between the gear teeth and the walls of the gear cavity and moved along the periphery of the gear cavity until it reaches the point at which the gear teeth engage. This action sets up a pressure differential between the fluid inlet and the fluid outlet causing fluid flow.

The gears are coupled to axles that are rotatably supported in bearings. To reduce wear, the fluid being pumped may be circulated over the bearings. Bearings located below the gears, within the portion of housing having the inlet and outlet ports, can be awash in the fluid by porting the inlet or outlet into a chamber in which the bearings are located. Lubricating the bearings above the gears has been a difficult problem usually requiring drilling channels and ports into the housing and bearings. Many designs also required that through-holes be drilled through the end, or other exterior surface, of the housing. Such through-holes would then require additional covers to seal the fluid pathways. These secondary manufacturing steps and parts are costly and the results are not satisfactory.

Gear pumps are sometimes referred to as positive pressure pumps because they continue generating pressure at the outlet in spite of downstream obstacles that may block the fluid path. There is no path by which fluid can flow "backward" through the gears unless there is a failure of the components. For this reason, many gear pumps incorporate relief valves for those conditions when pressure in the fluid outlet path exceeds a safe pressure.

An example of a fluid gear pump is shown and described in U.S. Pat. No. 4,846,641.

SUMMARY OF THE INVENTION

A preferred embodiment of the present invention is a gear pump having a housing with a bearing receptacle that can receive bearings. The bearing receptacle and bearings are appropriately sized so that the bearings do not fill the entire receptacle, thus defining a fluid flow path through the portions of the receptacle having no bearings therein.

A gear cavity, also formed in the housing having the bearing receptacle, receives the gears. Gear axles are rotatably supported by the bearings. Fluid from the output of the gears flows along a fluid path between the bearings and the housing and then through the bearings to lubricate the bearing-axle interface.

Various advantages and features of novelty which characterize the invention are particularized in the claims forming a part hereof. However, for a better understanding of the invention and its advantages, refer to the drawings and the accompanying description in which there is illustrated and described preferred embodiments of the invention.

DETAILED DESCRIPTION OF THE PREFERRED EMBODIMENTS

Figure 1:
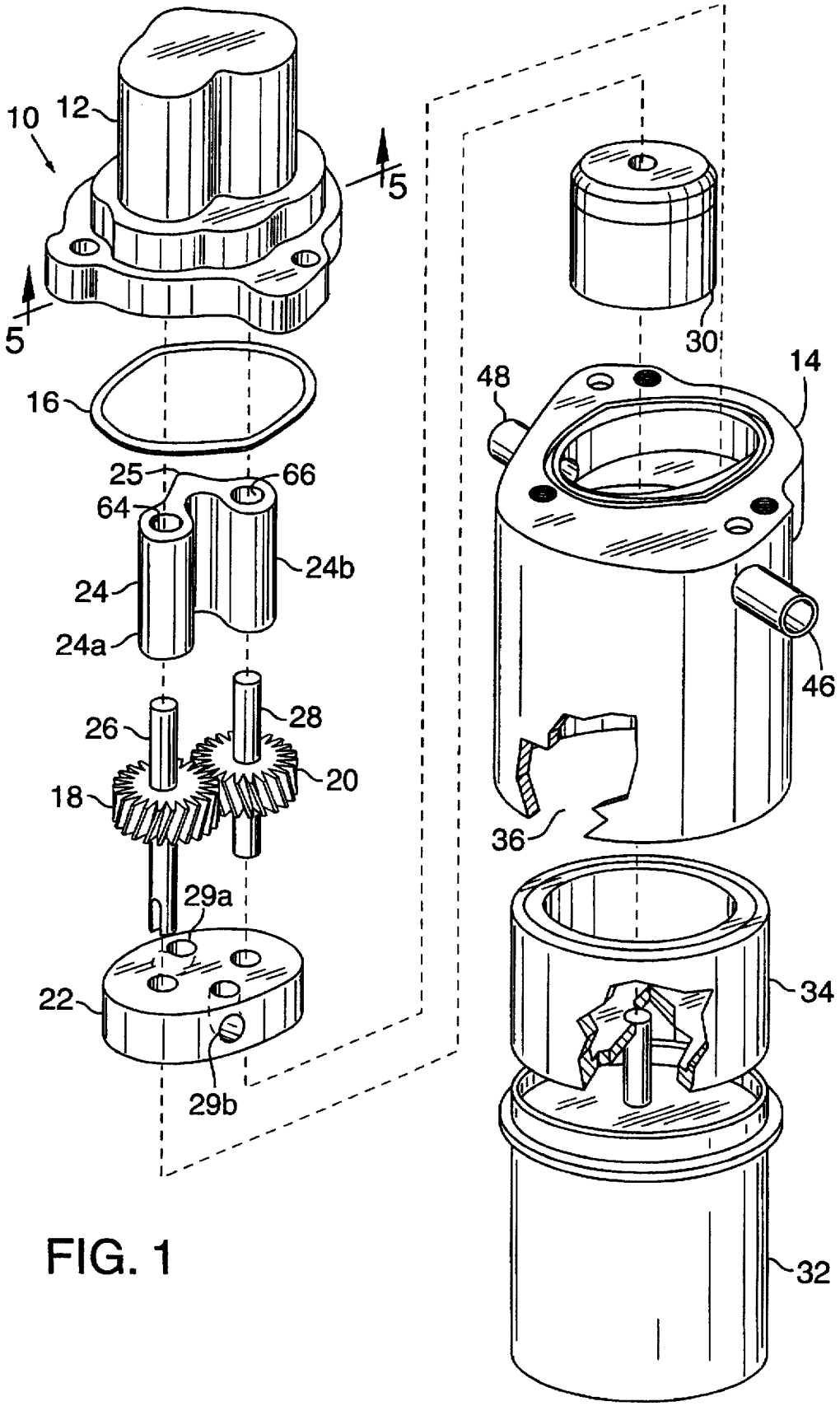
FIG. 1 is an exploded view of a preferred embodiment of a gear pump of the present invention.

In the accompanying FIGS. 1–5, there is shown a preferred embodiment of a gear pump 10. Referring specifically to FIG. 1, the gear pump 10 includes an upper housing, or end cap, 12 that couples to a lower housing, or manifold, 14. Between the housings is an o-ring 16 that seals the connection between the cap 12 and the manifold 14. Located within the housings are gears 18 and 20, bearing plate 22 and coupled bearings 24 which comprise bearings **24*a*, 24*b* and bridge 25. Axles 26 and 28 are coupled to the gears 18 and 20, respectively, and are rotatably supported in the coupled bearings 24 and the bearing plate 22**.

The bearing plate 22 includes portals **29*a* and 29*b*** for conducting fluid through the pump as explained in greater detail below.

Axle 26 is further coupled to a driven magnet 30 that is rotatably received within the manifold 14. A motor 32 is likewise coupled to an annular magnet 34 that fits within a recess 36 below the manifold 14 so that it is coaxial with the driven magnet 30. Actuation of the motor 32 rotates the annular magnet 34 which is magnetically coupled to the driven magnet 30 thereby rotating axle 26 and the gear 18. Because the gears 18 and 20 are meshingly engaged, gear 20 also is rotated.

Figure 5:
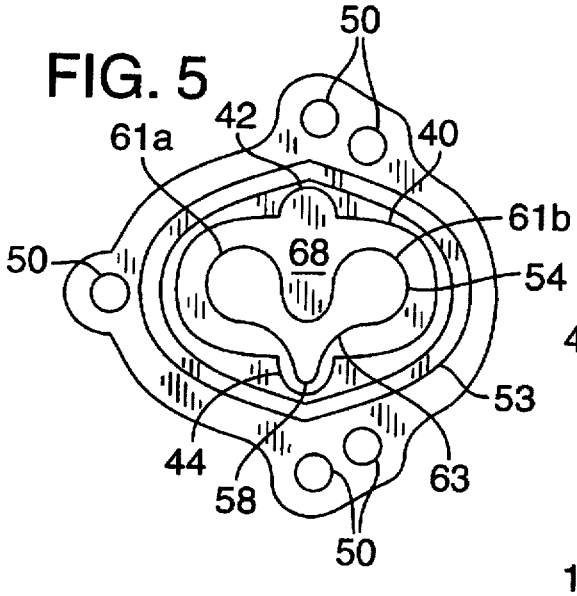
FIG. 5 is a bottom plan view as viewed along line 5—5 of an upper housing, or cap, of the gear pump shown in FIG. 1.
Figure 2:
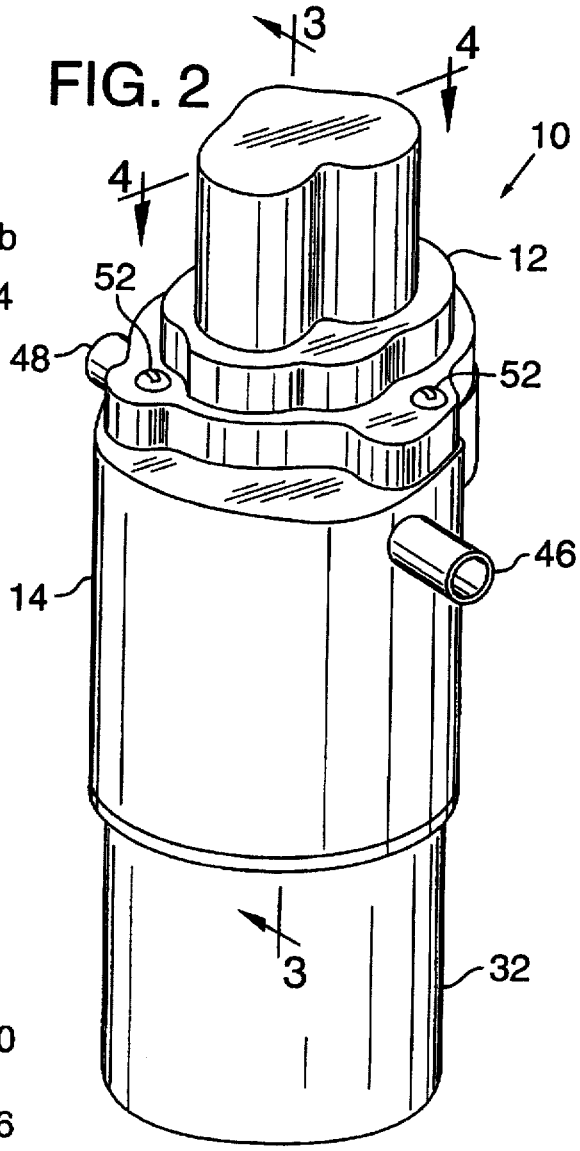
FIG. 2 is a perspective view of the gear pump of FIG. 1.

The cap 12, a bottom view of which is shown in FIG. 5, includes a gear cavity 40 that is sized to receive the gears 18 and 20. The gear cavity 40 also defines a fluid inlet recess 42 and a fluid outlet recess 44. The fluid inlet recess 42 is in communication with portal **29*b* and a fluid inlet port 46 in the manifold 14. The fluid outlet recess 44 is in fluid communication with portal 29*a* and an outlet port 48, also located in the manifold 14. The bearing plate 22** thus forms a lower wall of the gear cavity.

The cap 12 also includes a plurality of mounting holes 50 that receive fasteners 52 so the cap may be securely coupled to the manifold 14. An annular groove 53 is provided in the cap 12 for receiving the o-ring 16.

The cap 12 further includes a bearing receptacle 54 that is sized and arranged to receive the coupled bearings 24 and to define a fluid flow path 56 that includes a supply path 58 and a return path 60 (through the bearings). The bearing receptacle includes lobes **61*a* and 61*b* and interconnecting channel 63**.

The design of the cap 12 permits it to be formed, as by molding, as a single homogeneous unit without secondary operations such as drilling or piercing to create a fluid path for lubricating the upper bearings, in this case bearings **24*a* and 24*b*. The preferred cap design permits a substantially simpler manufacturing process. It is necessary to have only a female mold that forms the outside shape of the cap 12 and a male plug that forms the recesses 42, 44, gear cavity 40 and bearing receptacle 54. Insertion of the bearings then defines, in conjunction with the receptacle, the flow path 56. It is thus possible to avoid undesirable through-holes. The integrity of the outer surface of the cap 12** is not compromised by covers, seals or openings.

Some secondary operations may be required such as deburring the molded cap to remove mold lines, gate debris and sprue residue. Additionally, holes 50 may be formed by secondary operations.

Figure 3:
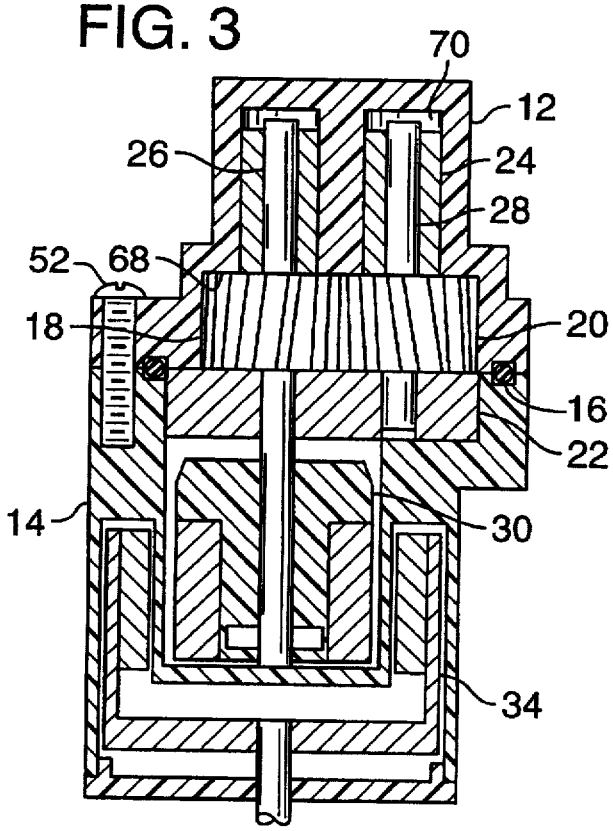
FIG. 3 is a cross-section view of the gear pump taken along lines 3—3 of FIG. 2.

As noted, the coupled bearings 24 are located in the bearing receptacle 54. However, the coupled bearings 24 are sized so that they do not completely fill the bearing receptacle 54. In particular, the coupled bearings 24 are shorter than the bearing receptacle 54 is deep, as can be noted in FIG. 3. Thus, the coupled bearings 24 may be inserted into the receptacle 54 and be made flush with an upper surface 68 of the gear cavity 40 to create a pocket 70 at the top of the bearing receptacle 54. (Although the cross section of FIG. 3 gives the appearance of separate pockets 70, comparison with the other figures reveals that the pocket 70 is continuous above the bearings 24*a* and 24*b* and bridge 25.)

When the motor 32 is actuated the gears 18 and 20 are caused to rotate and, as fluid enters the gear cavity, a pressure differential is created between the inlet and outlet ports in the manifold 14. Accordingly, there is a comparable fluid pressure differential in the gear cavity between the inlet recess 42 and the outlet recess 44. Fluid enters the gear cavity 40 at the inlet recess 42 and is entrained by the gears until it is discharged at the outlet recess 44. As noted, the outlet recess 44 is in fluid communication with the outlet port 48 thus pumping fluid out the outlet port to perform its intended function.

Gear pumps can create very high pressure fluid flow. The present invention has been designed primarily for pumps having a fluid pressure range of 50 to 100 pounds per square inch. However, the concepts and teachings of the present invention can be embodied in pumps having greater or lesser fluid pressures.

Figure 4:
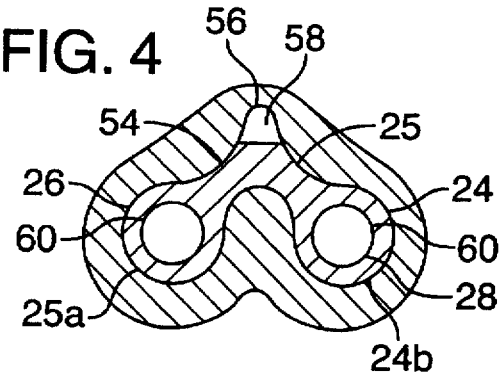
FIG. 4 is a cross-section view of the gear pump taken along lines 4—4 of FIG. 2.

As is best seen in FIG. 4, when the coupled bearings 24 are located in the bearing receptacle 54 the interconnecting bridge 25 does not completely fill the bearing receptacle 54 thereby leaving open the supply path 58 extending along the length of the bearing receptacle. Thus, the fluid path 56 extends along the supply path 58, located between the coupled bearings 24 and the wall of the bearing receptacle, to the pocket 70 and back along the return path 60 located between the bearings 24*a*, 24*b* and the axles 26, 28.

Supply path 58 begins within, or proximate, the outlet recess 44 so that high pressure fluid flowing out of the gears enters the outlet recess 44 and is forced into the supply path 58. After traveling through the supply path 58 the fluid enters the pocket 70 and then flows down into the bearings. Although not specifically shown in the figures (because of the small dimension) there is a very small gap between the gears 18, 20 and the upper surface 68 of approximately 0.001 to 0.003 inches (25.4×10–6 to 76.2×10–6 meters). The fluid is able to escape from the bearings through the gap into the lower pressure inlet recess 42. Fluid flow along the fluid path 56 lubricates the axles 26, 28 within the coupled bearings 24.

The tolerance between the axles 26 and 28 and the bearings 24*a*, 24*b* allows for a radial space between the outside surface of the axles and the interior surface of the bearings of approximately 0.0005 inches (12.70×10–6 meters). This radial spacing allows the lubricating fluid to flow between the bearings and the axles.

The fluid flow through the fluid path 56 is proportionate to the pressure difference across the inlet recess 42 and the outlet recess 44. When the pressure differential is greater, the fluid along the fluid path 56 will increase likewise.

The bearings 24*a* and 24*b* are represented as coupled cylindrical bearings connected by the arcuate bridge 25. As represented, bridge 25 extends the full length of the bearings. Alternative embodiments include bridges that extend only partly along the length of the bearings 24*a* and 24*b*. Additionally, an alternative embodiment of the present invention includes separate bearings 24*a* and 24*b* that may be installed into the bearing receptacle without an interconnecting bridge.

The gears 18 and 20 are represented as helical gears. Alternative embodiments could include spur gears. Additionally, the gear pump 10 is shown as a magnetically coupled gear pump. The invention could work equally well with alternative types of drive mechanisms such as direct drive.

Numerous characteristics and advantages of the invention have been set forth in the foregoing description, together with details of the structure and function of the invention. The novel features hereof are pointed out in the appended claims. The disclosure is illustrative only, and changes may be made in detail, especially in matters of shape, size, and arrangement of parts within the principle of the invention to the full extent indicated by the broad general meaning of the terms in the claims.

We claim:

1. A method of lubricating bearings in a gear pump, comprising the steps:

(a) casting a housing having a gear cavity and a bearing receptacle, the housing further having a fluid inlet recess and a fluid outlet recess;

(b) casting bearings having cylindrical portions coupled by an interconnecting bridge and installing the bearings into the bearing receptacle, wherein the bearings do not completely fill the bearing receptacle thus defining a fluid path that originates at the fluid outlet recess and extends between the bearings and the bearing receptacle and terminates at the fluid inlet recess;

(c) installing gears into the gear cavity, the gears including axles that extend through the gears and are rotatably supported by the bearings;

(d) installing the housing with bearings and gears onto a manifold having a fluid inlet port and a fluid outlet port that are in fluid communication with the respective fluid inlet recess and fluid outlet recess; and (e) driving the gears so as to create a pressure differential, wherein the pressure differential causes fluid to flow through the fluid path.

2. The method of claim 1 wherein the gears are driven by a coupled magnetic drive system.

3. The method of claim 1 wherein the bearing receptacle cast into the housing includes lobes interconnected by a channel and installation of the bearings further comprises locating the bearings into the lobes and locating the bridge in the channel.

4. A fluid pump for pumping fluid, comprising:

(a) a first housing and a second housing coupled together, the first housing defining a gear cavity and a single bearing receptacle, the gear cavity including a fluid inlet recess and a fluid outlet recess and the second housing including a fluid inlet in fluid communication with the fluid inlet recess and a fluid outlet in fluid communication with the fluid outlet recess;

(b) meshingly engaged gears rotatably mounted within the gear cavity such that rotation of the gears causes a fluid pressure differential between the inlet and the outlet recesses; and (c) coupled bearings located in the single bearing receptacle, the coupled bearings being sized and arranged so as to fill less than all the receptacle thereby defining a fluid path such that fluid flows from the fluid outlet recess through the bearings to the fluid inlet recess, and wherein the bearings are coupled by an interconnecting bridge and the bearing receptacle includes lobes interconnected by a channel, the bearings being located in the lobes and the bridge being located in the channel thereby defining the fluid path between the bridge and the bearing receptacle along the channel.

5. The fluid pump of claim 4 further comprising a bearing plate located in the second housing, the bearing plate rotatably supporting axles coupled to said gears.

6. The fluid pump of claim 4 wherein the bearings are coupled by an interconnecting bridge and the bearings include interior openings extending therethrough, the bearings and bearing receptacle further defining a pocket that defines a portion of the fluid path.

7. The fluid pump of claim 4 further comprising a bearing plate located in the second housing and arranged so as to form a wall of the gear cavity, the bearing plate including a port proximate the inlet recess and a port proximate the outlet recess.

8. The fluid pump of claim 4 further comprising a bearing plate having portals so that the fluid inlet is in fluid communication with the fluid inlet recess and the fluid outlet is in fluid communication with the fluid outlet recess and the first housing includes no fluid inlet and no fluid outlet.

* * * * *